United States Patent [19]

Scherer

[11] Patent Number: 4,932,894

[45] Date of Patent: Jun. 12, 1990

[54] INSULATED TERMINAL AND MODULE

[75] Inventor: Richard J. Scherer, Austin, Tex.

[73] Assignee: Minnesota Mining and Manufacturing Company, St. Paul, Minn.

[21] Appl. No.: 304,732

[22] Filed: Jan. 31, 1989

[51] Int. Cl.[5] ..... H01R 4/24

[52] U.S. Cl. ..... 439/409

[58] Field of Search ..... 439/389–410

[56] References Cited

U.S. PATENT DOCUMENTS

| | | | |
|---|---|---|---|
| 4,210,378 | 7/1980 | Baribeau | 339/97 R |
| 4,431,247 | 2/1984 | Abdullah et al. | 339/97 P |
| 4,705,340 | 11/1987 | Loose | 439/395 |
| 4,795,363 | 1/1989 | Scherer et al. | 439/409 |
| 4,795,364 | 1/1989 | Frantum, Jr. et al. | 439/409 |

*Primary Examiner*—Joseph H. McGlynn

*Attorney, Agent, or Firm*—Donald M. Sell; Walter N. Kirn; John C. Barnes

[57] ABSTRACT

In electrical terminals it is sometimes necessary to insert two wires into a contact adapted for insulation displacement connection and to do so successfully the wires must enter the wire receiving slot sequentially. A wire receiving opening aligned with the wire receiving slot should have a generally circular opening to readily receive the wires but when the wires are forced in the direction of the wire receiving slot a semi-circular concavity communicating with the opening and positioned on the side of the opening opposite the slot will receive one wire to feed the wires sequentially.

10 Claims, 3 Drawing Sheets

INSULATED TERMINAL AND MODULE

BACKGROUND OF THE INVENTION

1. Field of the Invention

This invention relates to electrical connectors, and in one particular aspect to a terminal useful at cross connect or serving area exchange points in communications systems, and more particularly to an improved cap for the terminals which cap affords connection of two wires at the terminal. Apparatus for making such connections typically includes terminals for 25 pairs of wires, arranged compactly in an array of rows and columns on a terminal block, for example as described in U.S. Pat. Nos. 4,210,378 and 4,431,247.

2. Description of the Prior Art

The existing terminal blocks as described in U.S. Pat. No. 4,431,247 serve to make a wire insulation displacement connection with the wire upon the twisting motion applied to the cap. The conductor to be connected extends through aligned holes in the cap and through an opening in a concentrically arranged stationary contact element which opening leads to an open mouthed wire receiving slot affording an insulation displacement connection (IDC) with the wire of the conductor. The opposite side of the contact has a second opening through which the conductor extends which is initially aligned with a companion second opening in the cap. Turning the cap to make the wire connection forces the wire against the edges of the second opening resulting in the conductor being severed simultaneously with the wire connection or termination being made.

This terminal afforded the rapid connection of service lines to the block which is in turn connected to the trunk line cable by lines joined to the base of the terminal block. However when there is a need to connect a second jumper wire to a terminal, this terminal was not suitable. It has thus been found that the cap can be modified to accept two wires of the same gauge, either 22 or 24 gauge. Two other solutions to this problem have been provided to the field such that two lines could be connected to a single terminal. These solutions are disclosed in U.S. Pat. No. 4,795,363 and application Ser. No. 132,214, filed Dec. 14, 1987, now U.S. Pat. No. 4,815,988. Two distinct uses were discovered for the improved devices of these prior patents, as they allowed a single wire to be fed through the terminal and connected to the terminal for maintaining a temporary connection to an old terminal while attaching the lines to a new terminal. Then, the extended end of the conductor placed through the cap in the terminal for the temporary connection to the older telephone number assignment was easily removed without another interruption in service to the new number.

Secondly, when making telephone extensions off-premises, a permanent connection featuring one wire will allow connection of the same phone number to two separate structures, such as a house and a garage or other outbuilding, or to an office and a laboratory within a single building. However, these devices required the feeding of the lengths of wire through the terminal to make the connection to the new terminal which was time consuming.

The present invention provides for the easy feeding of two wires into the contact of the terminal and connection of both wires in the same slot of the contact element. When it is desired to disconnect one of the wires it is simply removed from the terminal. This is afforded by the modification of the cap of the terminal to afford the feeding of two wires into the wire receiving slot of a bifurcated contact element. To assure the proper feeding of the wires into the slot without having one of them cut by the element, to make the feeding of the wires into the cap as easily as possible when the entrance opening is generally not clearly visible, and to provide a passageway through the terminal for the wires, and yet allow access through the top of the cap to a test tab positioned below the pair of wires, the opening into the cap must be modified. Such modification required a design which would afford the sequential feeding of the wires into the element and an opening larger than the pair of wires to make the original entry of the wires into the opening and passageway as convenient as possible.

SUMMARY OF THE INVENTION

The present invention comprises an improved shape for a wire accepting opening a connector element when the walls forming that opening are used to engage and guide a wire into a narrow slotted opening in a metal contact member where the insulation on the wire will be penetrated by the edge walls defining the slot and the contact will make pressure contact electrical connection with the conductor member of the wire.

An electrical terminal according to the present invention comprises a contact member having an entry passage in one side forming an entrance to an insulation displacing wire receiving slot and a cap surrounding the contact member. The improvement in the terminal is in the wire accepting and guiding opening or channel in the cap which can receive one or two wires easily in any orientation and upon movement of the cap in relationship to the contact member will guide the wires into the entry passage to the wire receiving slot. The wires will be guided into a side by side path and be forced into the slot sequentially, one wire at a time, to restrict any deleterious effect on the wires. The entry opening in the cap comprises a generally circular enlarged opening and a radially positioned arcuate semi-cylindrical concavity cut-out in the wall of the opening, or a truncated conical opening, communicating with said circular opening and positioned on the side of the circular opening opposite the entry passageway to the wire receiving slot for the purpose of receiving one of two wires placed in the cap for aligning said wires in sequential relationship, e.g. side-by-side relationship, as the walls of the cap defining said entry opening in the cap forces said wires into the wire receiving slot.

The wire receiving passageway leading to and positioned past a cut-off opening in the element is generally cylindrical affording a positioning of the wires in a position disposed approximately 90 degrees from the position at the entry opening or positioned one above the other depending on the orientation of the wire receiving slot.

BRIEF DESCRIPTION OF THE DRAWING

The present invention will be further described with reference to the accompanying drawing wherein.

DESCRIPTION OF THE PREFERRED EMBODIMENT

Figure 1:
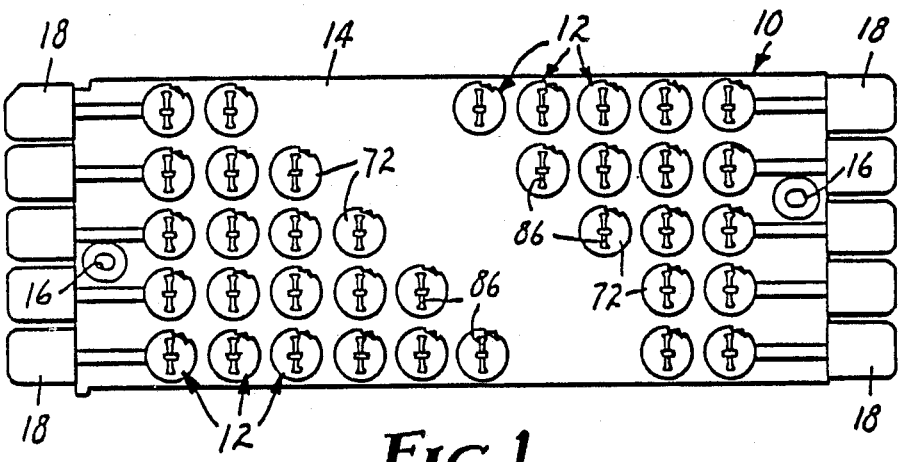
FIG. 1 is a plan view of a cross connect module comprising terminals formed according to the present invention.
Figure 2:
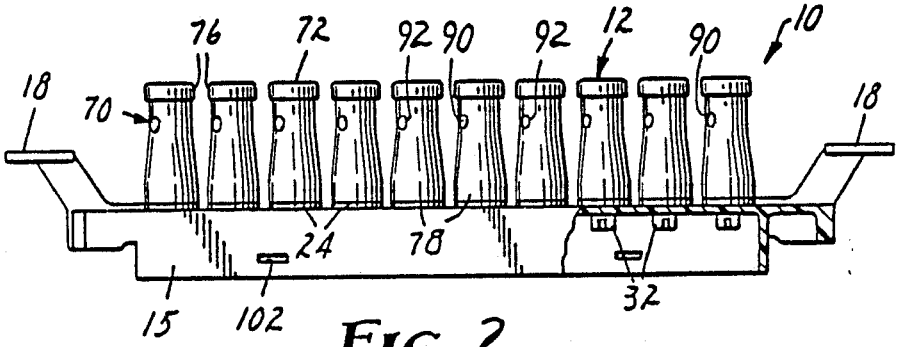
FIG. 2 is a front elevation.
Figure 8:
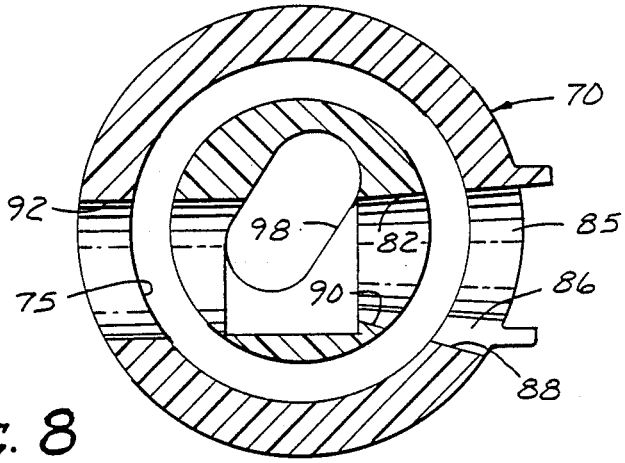
FIG. 8 is a horizontal sectional view of the cap taken along the line 8—8 of FIG. 6.

The module 10 of FIGS. 1-2 will be seen to include 50 separate terminals 12, disposed in five rows and ten columns. A similar module is illustrated in U.S. Pat. No. 4,431,247 which describes a base and tubular contact member, the description of which are incorporated by reference herein. The base 14, having lower walls 15, is dimensioned for mounting against a support within a cabinet by means of screws inserted through holes 16. Pads 18 at the ends of the base are provided for supporting and arranging individual wires or bundles of wires which are to be connected. Color coding is customarily added for ease of identification of tip and ring positions.

Figure 5:
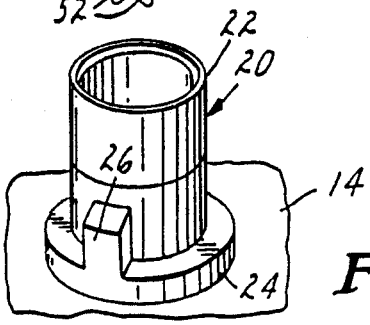
Figure 6:
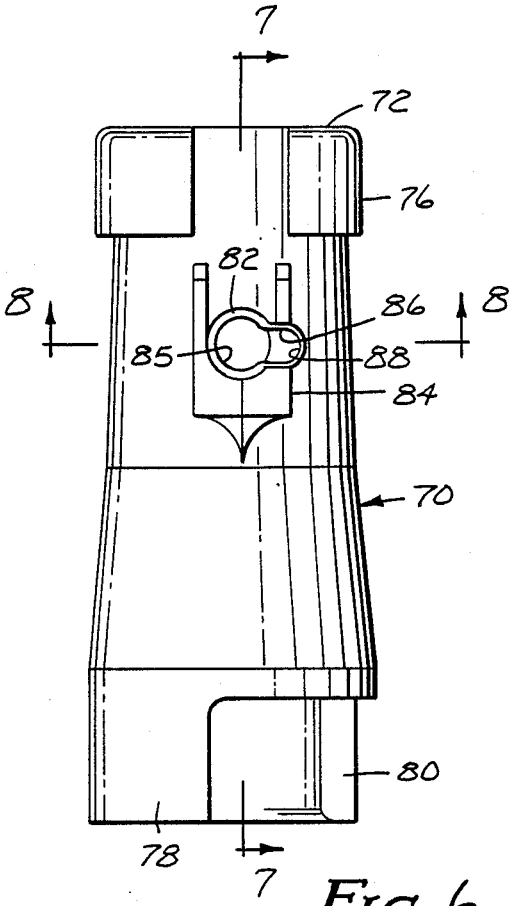
FIG. 6 is an enlarged side view of the cap.

The terminal 12 includes a body 20, FIG. 5, formed as a part of the base 14. It consists of a cup shaped segment having a slightly conical outer upper surface 22 and which is partially surrounded by crescent-like wall 24, the two of which are joined by a stop 26 and are spaced apart to receive the base of a cap 70 to be hereinafter described. The stop 26 extends upwardly from the base 14. The bottom of the cup, forming a portion of the base 14, is perforate and carries raised blocks 32, see FIG. 1, on the outer surface. Blocks 32 define a wire retaining pathway in alignment with the center of the perforation.

Figure 4:
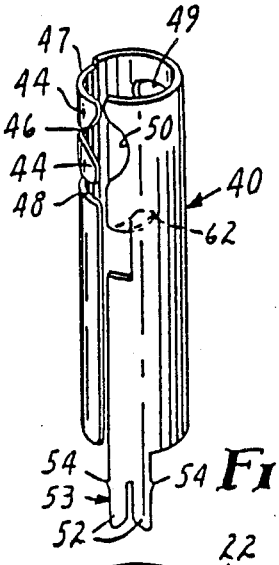

A tubular or generally cylindrical contact member 40 of FIG. 4 is formed from a flat blank. It has a pair of laterally directed contact fingers 44 defining an open mouthed wire receiving slot 46. A marginal space or partial slot 47 above, and a second slot 48 below, serve to isolate the resulting bifurcate contact element and to permit necessary slight deflection of the contact fingers 44 during insertion of a conductor in slot 46 to make an insulation displacing wire connection with the contact member. Perforation 49, and semi-circular concavity 50 together with the open mouth of the contact element between the angled inner edges at the tips of fingers 44, form a transverse passageway for a wire, generally diametrically through the tubular connecting member 40.

A second pair of contact fingers 52 depending from the lower edge of the member 40 and forming an extended second bifurcate contact element 53 extends through the arcuate opening in the base and against and beyond the block 32. Angular projections 54 on the longitudinal edges of the extension penetrate the walls of the perforation and anchor the member 40 to the base 14.

A tongue 62 is cut from the edge of the cylindrical member 40 beneath the concavity 50 and is bent inwardly to form a contact tab extending horizontally across the center of the cylindrical connecting member 40, as shown in FIG. 4.

A cap 70 surroundingly telescopically receives the cylindrical contact member 40 and is also generally cylindrical, with a top wall 72 from which depends a circular wall segment 74, leaving an annular space 75. The cap fits over the upper portion of the tubular member 40 which extends into the annular space 75, and over the tubular shell of the cup shaped segment of the body 20. Upper and lower portions 76, 78 of the cap are radially enlarged for increased strength. A segment of the lower rim is omitted, leaving a space 80 which permits the cap to fit over the stop 26 between the body 20 and the wall 24 and to be rotated thereon through approximately one quarter turn or the degree necessary to establish electrical connection with one or two wires inserted into the terminal.

The cap 70 including the wall segment 74, is laterally perforate at the level of the transverse passageway in the member 40, to provide a generally cylindrical wire receiving channel 82. The outer surface of the cap is enlarged and chamfered below a wire accepting and guiding entrance to this channel, as at boss 84, so as to facilitate the insertion of a wire end into the channel.

Figure 7:
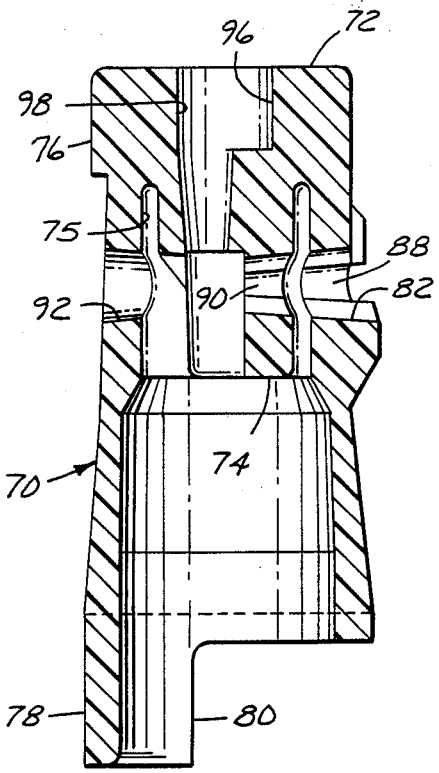
FIG. 7 is a vertical sectional view of the cap taken along lines 7—7 of FIG. 6.

The wire receiving channel 82 is generally cylindrical except at the wire accepting entrance opening 85 above the boss 84 where one or two wires can be inserted easily in any orientation and upon rotation of the cap will be guided into the open mouth passage to the wire receiving slot 46. The wire or wires will be guided by the presence of a semi-cylindrical or truncated cylindrical cut-out or concavity 86 communicating with the channel 82 at the entrance end thereof. The opening 85 and concavity 86 may be slightly larger than the passageway to afford relief in the molding so the passageway is illustrated as conical or tapered toward the center of the cap. In any event the channel 82 is generally cylindrical and the cut-out is a truncated cylindrical concavity whether the wall surface is cylindrical or conical. The concavity 86 defines a wire accepting passage disposed on one side of the wire receiving opening of the channel 82 and defines an opening like a keyhole adjacent the outer surface of the cap 70. The walls of the cap defining the passage 86 and the channel 82 are disposed to guide a wire or two wires of the same size into the wire receiving slot 46. The passage 86 allows one wire to be received therein upon rotation of the cap 70 to urge the wires into the wire receiving slot 46. If there are two wires present in the wire receiving channel 82 the presence of the concavity, positioned on the side of the generally circular opening to the channel 82 opposite the mouth of the wire receiving slot 46, serves to position the wires in a position to be sequentially urged into the slot 46, e.g. a side-by-side orientation, such that the wires will be successively feed into the slot 46 rather than both of the wires being urged against the angled inner edges of the mouth leading to the slot 46. The walls 88 and 90 of the passage 86, see FIG. 7, are disposed on opposite sides of the element 40 disposed in the annular space 75 and these walls urge the wires into the slot without excessive bending of the wires. Past the wall 90 the wires will again engage a cylindrical wall and the wires will be twisted and positioned, not side-by-side but one above the other. The wires are so positioned at the exit opening 92 where they are urged against the circular edge of the opening 49 and the extended ends of the wires are cut. Thus the purpose of the generally circular enlarged opening and the radially positioned truncated cylindrical opening, communicating with the circular opening and positioned on the side of the circular opening opposite the entry passageway to the wire receiving slot, is for the purpose of receiving one of two wires placed in the wire receiving channel 82 and aligning said wires in sequential relationship, e.g. side-by-side relationship, as the walls of the cap, defining the entry opening in the cap, forces the wires into the wire receiving slot.

Figure 3:
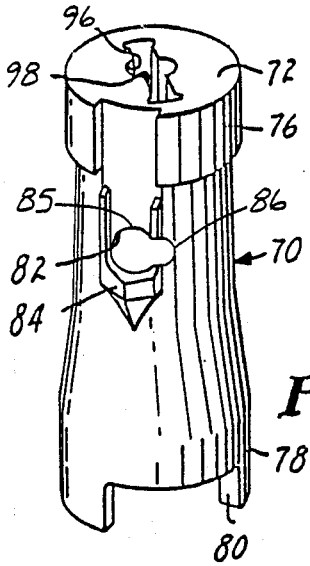
FIGS. 3, 4 and 5 are perspective views, in axial alignment, of a cap, illustrating the side of the cap opposite that of FIG. 2, the contact element, and body respectively of one of the terminals of the module of FIG. 1.

The top of the cap is slotted and perforate. As illustrated in FIGS. 1, 3 and 7 a slot 96 is in line with the column transverse to the base 14 when the connector is open to receive a wire end, with the left edge of the lower cap portion 78 against the stop 26. The perforation 98 is parallel to and closely adjacent the longitudinal axis. It extends through the top wall 72 and in line with the contact tab 62. At the position of the perforation 98 the wires are twisted or moved to a position allowing access to the contact tab 62 through the perforation 98 upon the rotation of the cap for a direction and amount corresponding to the space 80 such that rotation of the cap 70 from the stop 26 permits the cap to urge one or two wires into the slot 46 and to twist the wires to a position to be cut at the perforation 49.

Cross connect wires of 24 AWG (0.5 mm) are connected to the individual terminals by inserting the wire or wires through the entrance opening 85 and through the channel 82 and twisting the cap through the arc permitted by the stop 26. The wires are forced between the fingers 44 which displace the insulation and make spring compress-on reserve contact with the conductor. Twisting action is accomplished with an ordinary screwdriver the bit fitting into the slot 96. If contact with the connection is desired, as for testing purposes, the aperture 98 provides for access of a suitable test probe to the tab 62. When connection of a terminal to two locations is no longer desired, the cap is rotated part of the permitted distance of rotation to urge one of the wires out of the slot and into the mouth and the wire is removed. The cap can be rotated again against the stop to secure the other wire in the contact.

In a preferred example the entrance opening is initially about 2.54 mm in diameter, that is at the outer surface of the cap 70, and taper to about 1.9 mm. The opening 85 has a radius at least equal to twice the radius of the cut-out. The passage 86 has a diameter of about 2 mm and its wall 88 extends to a position about 1.1 mm beyond the arc of the circular entrance opening and tapers toward the center of the cap at an angle of 14 degrees to the axis of the cylindrical passageway 82.

The opening of this shape is disclosed as being useful in urging the wires generally horizontally into a wire receiving slot but the opening is equally suitable to urge two wires placed in a cap vertically downward or upward into a wire receiving slot of a contact adapted to receive two wires in insulation displacing contact therewith.

Having thus described the invention with reference to a specific embodiment, it is to be understood that changes may be made without departing from the present invention as defined by the appended claims.

I claim:

1. An electrical terminal for making electrical contact with a plurality of wires of substantially similar size comprising:

a contact member having a bifurcate wire receiving contact defining a wire entry slot, and a cap member associated with said contact member and adapted to fit over said contact and having a channel formed therethrough for receiving a plurality of wires and forcing said wires into said wire entry slot of said contact member, said channel being formed with a first circular opening leading into said channel and an arcuate cut-out communicating with said circular opening and radially aligned with said circular opening in a direction spaced from said wire entry slot, said arcuate cut-out having a size to accommodate a single wire of a said plurality of wires.

2. An electrical terminal according to claim 1 wherein said cut-out is positioned adjacent one end of said channel and has a truncated cylindrical concave shape.

3. An electrical terminal according to claim 1 wherein wall means define said arcuate cut-out and a shape for urging the wires in a position to be sequentially moved into said wire entry slot.

4. An electrical terminal according to claim 3 wherein the first circular opening has a radius at least equal to twice the radius of the arcuate cut-out.

5. An electrical terminal comprising a cylindrical contact member having an entry passage in one side forming an entrance to an insulation displacing wire receiving slot and having a perforation opposite said wire entry passage to form a wire exit passage, and a cap rotatable and generally coaxially associated with and surroundingly telescopically receiving said cylindrical contact member and having a channel in line with said passages for receiving two wires and forcing said wires into said contact element wire receiving slot, said channel having wall means defining a wire accepting and guiding opening at one side of the cap for receiving the wires easily in any orientation and upon, rotation of the cap, for guiding the wires into the entry passage to the wire receiving slot sequentially, said wall means defining a generally circular enlarged opening and a radially positioned arcuate truncated cylindrical concavity formed in the wall of the opening and communicating with said circular opening and positioned on the side of the circular opening opposite the entry passage to the wire receiving slot.

6. An electrical terminal according to claim 5 wherein said concavity is tapered in relationship to said channel to define a diminishing truncated passageway in the cap on one side of said channel.

7. An electrical terminal according to claim 5 wherein said cap includes means for restricting rotation of said cap to the degree necessary to establish electrical connection with a wire inserted by said wall means defining said concavity.

8. An electrical terminal according to claim 1 wherein said circular opening has a diameter of about 2.54 mm and the concavity has a radius of about 1 mm.

9. An electrical terminal according to claim 5 wherein said circular opening has a diameter of about 2.54 mm and the concavity has a radius of about 1 mm.

10. An electrical terminal for making electrical contact with the conductors of a plurality of insulated wires of substantially similar size comprising:

a metal contact member having means defining a narrow wire receiving slot and a mouth leading to said slot for receiving the insulated wires, and a cap member associated with said contact member and adapted to move in relationship to said contact member, said cap member having channel means for receiving a pair of wires and for guiding said wires into said slot, said channel means being disposed in adjacent relationship to said mouth of said slot in one position and movable to a second position to force said wires from the mouth of said slot into said slot when moved to said second position, said channel means including a first generally circular wire receiving portion having a first radius to receive a pair of wires therein and a concavity in one side wall of the circular wire receiving portion opposite the slot of the contact member, the radius of said concavity being smaller than that of said first radius to receive only one wire, for receiving and guiding the wires of a said pair of wires sequentially into said slot upon movement of said cap member from said one position to said second position, whereby said channel means adjacent said contact member is generally keyhole shaped in cross section.

* * * * *